US009543086B2

(12) United States Patent
Ermel et al.

(10) Patent No.: US 9,543,086 B2
(45) Date of Patent: Jan. 10, 2017

(54) POWER CIRCUIT BREAKER

(71) Applicant: TECHNISCHE UNIVERSITÄT BRAUNSCHWEIG, Braunschweig (DE)

(72) Inventors: Vladimir Ermel, Halle/Saale (DE); Michael Kurrat, Braunschweig (DE)

(73) Assignee: Technische Universitat Braunschweig

( * ) Notice: Subject to any disclaimer, the term of this patent is extended or adjusted under 35 U.S.C. 154(b) by 0 days.

(21) Appl. No.: 14/652,971

(22) PCT Filed: Dec. 20, 2013

(86) PCT No.: PCT/EP2013/003890

§ 371 (c)(1),
(2) Date: Jun. 17, 2015

(87) PCT Pub. No.: WO2014/095079

PCT Pub. Date: Jun. 26, 2014

(65) Prior Publication Data

US 2015/0332878 A1 Nov. 19, 2015

(30) Foreign Application Priority Data

Dec. 21, 2012 (DE) ..... 10 2012 025 115

(51) Int. Cl.
*H01H 9/36* (2006.01)
*H01H 23/08* (2006.01)
(Continued)

(52) U.S. Cl.
CPC ..... *H01H 9/36* (2013.01); *H01H 33/08* (2013.01); *H01H 33/10* (2013.01); *H01H 33/164* (2013.01);
(Continued)

(58) Field of Classification Search
CPC ..... H01H 33/08; H01H 33/10; H01H 33/20; H01H 33/164; H01H 33/596; H01H 33/664; H01H 33/6647
(Continued)

(56) References Cited

U.S. PATENT DOCUMENTS 4,010,338 A * 3/1977 Amsler ..... H01H 33/6646 200/307
4,246,458 A * 1/1981 Yanabu ..... H01H 33/664 106/287.17
(Continued)

FOREIGN PATENT DOCUMENTS

DE 26 30 701 12/1977
EP 0 092 207 10/1983
(Continued)

OTHER PUBLICATIONS

Translation of JPH03230436 (org. doc. published Oct. 14, 1991).*
Translation of FR2356256 (org. doc. published Jan. 20, 1978).*

*Primary Examiner* — Renee S Luebke
*Assistant Examiner* — William Bolton
(74) *Attorney, Agent, or Firm* — Salter & Michaelson

(57) ABSTRACT

The invention relates to a power circuit breaker that is suitable for switching electrical voltages. The power circuit breaker according to the invention comprises two main electrodes, to each of which a respective pole of the voltage to be switched can be connected. During the switching process, at least one of said main electrodes follows a switching path. The power circuit breaker is characterized in that secondary electrodes are additionally provided, which protrude into the vicinity of the switching path and are designed and arranged in such a way that arcs can be produced (a) between the main electrodes and the secondary electrodes and (b) between the individual secondary electrodes during the switching process. The power circuit
(Continued)

breaker according to the invention can be advantageously used in vehicles and in ultra-high-voltage AC and HVDC (high-voltage direct current) transmission systems and causes arcs to be extinguished as early as possible during the switching process.

17 Claims, 5 Drawing Sheets

(51) Int. Cl.

| | |
|---|---|
| ***H01H 33/10*** | (2006.01) |
| ***H01H 33/16*** | (2006.01) |
| ***H01H 33/20*** | (2006.01) |
| ***H01H 33/59*** | (2006.01) |
| ***H01H 33/664*** | (2006.01) |
| ***H01H 33/08*** | (2006.01) |

(52) U.S. Cl.
CPC ..... *H01H 33/20* (2013.01); *H01H 33/596* (2013.01); *H01H 33/664* (2013.01); *H01H 33/6647* (2013.01)

(58) Field of Classification Search
USPC ..... 218/118, 10, 126
See application file for complete search history.

(56) References Cited

U.S. PATENT DOCUMENTS

| | | | | | |
|---|---|---|---|---|---|
| 4,267,415 | A | * | 5/1981 | Holmes | H01H 33/66261 218/139 |
| 4,295,021 | A | * | 10/1981 | Asinovsky | H01H 33/08 218/34 |
| 4,346,273 | A | * | 8/1982 | Meyer | H01H 33/18 218/23 |
| 4,458,121 | A | | 7/1984 | Yanabu et al. | |
| 5,591,948 | A | * | 1/1997 | Bolongeat-Mobleu | H01H 33/125 218/68 |
| 2012/0234796 | A1 | | 9/2012 | Juhlin | |

FOREIGN PATENT DOCUMENTS

| | | | | |
|---|---|---|---|---|
| FR | 2356256 | * | 1/1978 | H01H 33/66 |
| JP | S63 314728 | | 12/1988 | |
| JP | H03 230436 | | 10/1991 | |
| JP | 2000 021276 | | 1/2000 | |
| WO | 2011/050832 | | 5/2011 | |

* cited by examiner

POWER CIRCUIT BREAKER

TECHNICAL FIELD

The present invention relates to a power circuit breaker that is suitable for switching electrical voltages or electrical currents and powers.

BACKGROUND OF THE INVENTION

Usually, a power circuit breaker contains two electrodes, to each of which, in operation, a respective pole of the voltage to be switched is applied. In particular when the electrodes are separated, there is a high likelihood that an undesired arc will occur. Even when this arc is extinguished in the meantime, there is the danger that it can reignite and indeed continue to do so until the separating gap is sufficiently large.

In order to ensure that such arcs are extinguished insofar as possible, the insulating gas $SF_6$ (sulfur hexafluoride) is utilized in many known high-voltage power circuit breakers. However, this is a very strong greenhouse gas, which can escape into the atmosphere, particularly in the event of leakage and after the end of the service life.

Therefore, in particular for reasons of environmental compatibility, vacuum circuit breakers were developed for switching high voltages. In order to prevent arcing in vacuum circuit breakers, they are generally employed in alternating current systems. For alternating current, there is a periodic zero-crossing of the current, which is favorable to extinguishing the arc.

However, there is an increased need for the transmission of high-voltage direct current. Such systems of high-voltage direct current transmission (HVDC) have been proposed in current discussions by various parties on the energy transition and the expansion of the electrical grid, in particular for the connection of off-shore wind parks or the installation of coupling points. This is because direct current technology appears to be advantageous for higher powers given identical line widths, longer distances, and, above all, longer cable connections.

The reliable switching of high direct-current voltages is often realized by connecting a plurality of high-voltage power circuit breakers in series.

The European Patent EP 0 556 616 B1—or its German translation DE 693 02 716 T2—describes a direct current breaker arrangement that closes a commutating switch after interruption of a vacuum circuit breaker and transforms arcing direct current into an alternating waveform by means of commutation so as to end the interruption. This is intended to interrupt a direct current reliably so as to prevent any escalation of an operational malfunction.

The object of the present invention is to be able to switch an alternating current or direct current (or a corresponding power) in a simple and reliable way.

SUMMARY OF THE INVENTION

This object is achieved by the power circuit according to claim 1. Advantageous further developments are presented in the dependent claims.

The power circuit breaker according to the invention comprises two electrodes, to each of which can be connected a pole of an electrical voltage, which can be switched on or off. These electrodes also will be referred to as main electrodes in the following. The switch according to the invention is fundamentally suitable for switching voltages of any values. In doing so, arcing is to be prevented or the existence thereof during the switching operation is to be ended as soon as possible. For this reason, the switch according to the invention is especially suitable for all fields of application in which such arcs are particularly detrimental, such as, for example, in vehicles having an electric powertrain and/or internal-combustion engines, as well as during switching of high voltages. High voltage is understood here to mean a voltage that can have a value of approximately 50-500 kilovolts or even more. The power circuit breaker offers special advantages as part of a system for the transmission of ultrahigh-voltage alternating current (AC) or of high-voltage direct current (HVDC).

The main electrodes have to be brought together or separated for the switching operation. This generally occurs by a mechanical movement of one of the two main electrodes. The other main electrode is then stationary, that is, fixed in position inside of the power circuit breaker. However, it is also conceivable that the two main electrodes are moved simultaneously or successively.

This switching movement takes place along a switching path. This path usually is rectilinear and, namely, perpendicular with respect to the switching surface of the stationary main electrode. However, any other form that is advantageous for mechanical and/or electrical reasons, is also conceivable.

The present invention is characterized in that there is at least one secondary electrode. This secondary electrode (or a plurality thereof) protrudes into the region in the vicinity of the switching path. As a result of this, a main arc forms between the two main electrodes during the separation process and as the distance of the main electrodes from each other progresses, additional arcs are formed and in fact, between the main electrodes and the secondary electrode. These additional arcs are thus switched parallel to the original main arc and cause the latter to be extinguished substantially earlier than in the case of hitherto known power circuit breakers. In order to optimize the creation of additional arcs, it is advantageous when the minimum distance between the switching path and the secondary electrode is less than 10 mm, with values between about 0.5 to 1 mm having especially proven useful.

The invention is based on the realization that the existence of arcs is unstable and obeys statistical laws. When a plurality of individual arcs then arise instead of a main arc and are connected virtually in series, there is a markedly greater probability that one of these individual arcs is extinguished. When this happens, the other individual arcs will also be extinguished quickly, as a result of which the entire chain of arcs is ultimately extinguished. Through the creation of such a chain of arcs instead of a single main arc, the presence of arcs during the switching process is ended more quickly and the operational reliability of the power circuit breaker is thus increased.

The presence of the secondary electrodes according to the invention is fundamentally possible for a power circuit breaker that contains a gas such as the insulating gas $SF_6$, for example. However, the arrangement of the secondary electrodes is especially advantageous in vacuum power circuit breakers in which a gas pressure in the range of $10^{-4}$ to $10^{-8}$ mbar prevails, with values in the range of $10^{-5}$ to $10^{-7}$ mbar usually being especially preferred.

The secondary electrode (or a plurality thereof) can be designed in various ways. In order to be able to ensure the greatest possible operational reliability, it has proven useful to design the secondary electrode in the shape of a ring or a flat area, with an opening being provided through which the switching path passes.

It has proven further useful when the secondary electrode (or a plurality thereof) has a contour, as a result of which it is thinner in the region of the switching path than on the side facing away from the switching path. Such a contour can be realized, for example, by a triangular course (see also FIG. 5). It is also conceivable that the respective secondary electrode has a curved profile (see also FIG. 4), which can be described on the basis of a small radius (r) and a large radius (R), with r<R.

For further increase in the operational reliability, it has proven useful when a plurality of secondary electrodes are present, at least individual ones of which are connected together electrically by an electronic grid, which includes at least one varistor and/or at least one ohmic resistor.

DESCRIPTION OF THE DRAWINGS

In the following, further details and advantages of the present invention are described on the basis of preferred exemplary embodiments. Shown are.

DETAILED DESCRIPTION

Identical and similar means are provided in the figures with identical reference numbers. A repeated description occurs only insofar as it seems necessary for understanding the invention or exemplary embodiments. Although the exemplary embodiments describe the switching of high voltage, it is pointed out once again that the power circuit breaker according to the invention is suitable for the switching of electrical voltages of any value.

Figure 1:
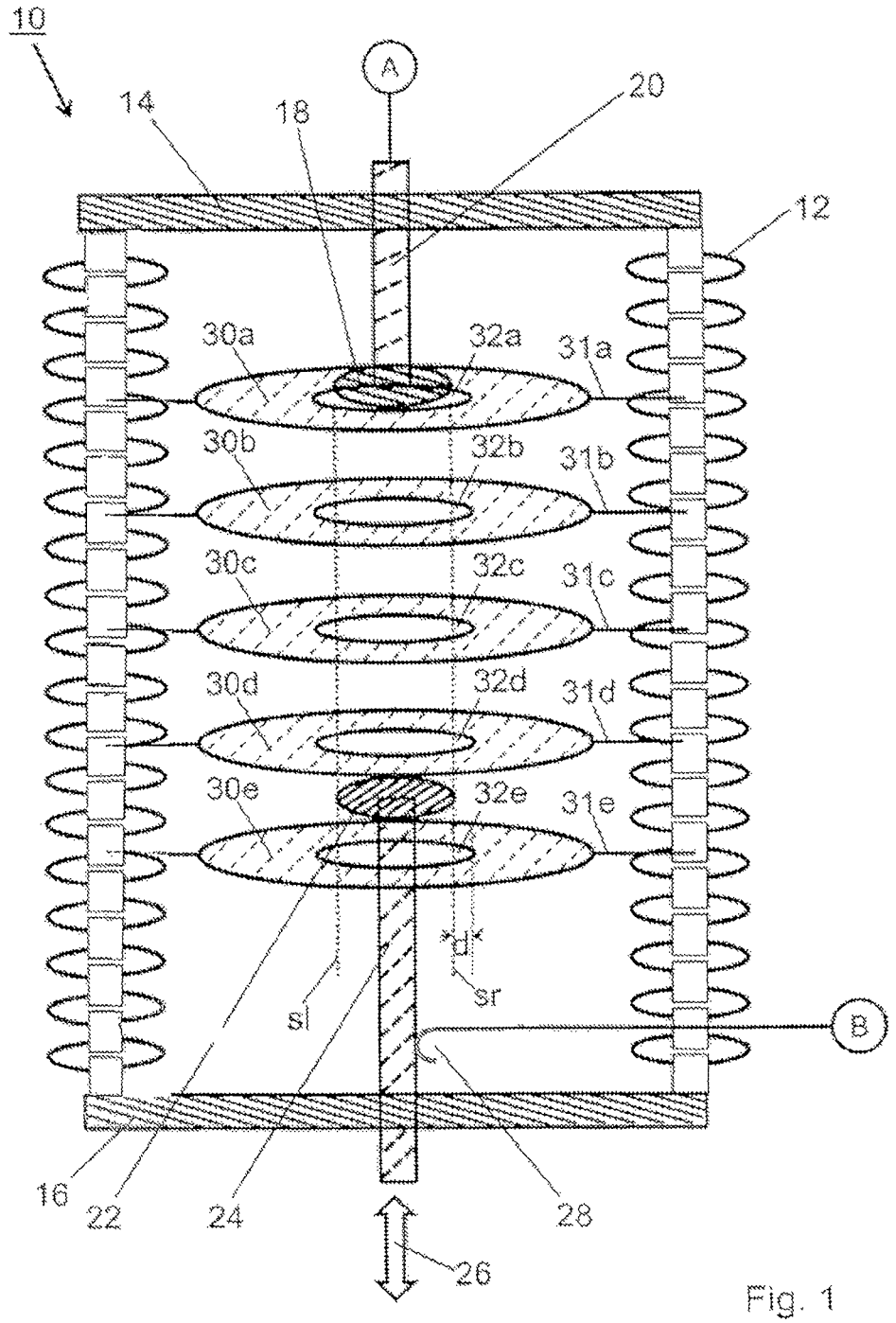
FIG. 1 a symbolic illustration of a power circuit breaker

FIG. 1 shows a symbolic illustration of a preferred power circuit breaker 10, which is suitable for switching direct voltages of up to 100 kV and more. It is preferably designed as a vacuum circuit breaker in which a pressure of approximately $10^{-6}$ mbar usually prevails. The preferred embodiment is essentially circularly symmetrical or cylindrically symmetrical in design. This means that the housing of the power circuit breaker 10 comprises an essentially cylindrically shaped insulator 12 as well as a top end plate 14 and a bottom end plate 16, each of which is nearly disc-shaped. The power circuit breaker 10 further contains a top main electrode 18 having a top shaft 20 and a bottom main electrode 22 having a bottom shaft 24. A high voltage can be switched on or interrupted via the main electrodes 18, 22. The two shafts 20, 24 are electrically conductive and each of them is in both mechanical and electrically conductive connection with its respective main electrode 18 and 22.

The top shaft 20 is fastened to the top end plate 14, so that the top main electrode 18 is nearly fixed in position inside of the power circuit breaker 10. A top junction port A, to which the first pole of the high voltage to be switched can be applied, is connected to the top main electrode 18 via the electrically conductive top shaft 20. The bottom shaft 24 can be moved perpendicularly back and forth along the arrow 26 through an opening, which is not depicted here, inside of the bottom end plate 16. In this way, it is thus possible to move the bottom main electrode 22, that is, up and down, along a switching path, which is indicated here by the dashed lines sl and sr. The second pole of the high voltage to be switched can be applied via a bottom junction port B. This port B is in electrically conductive connection with a sliding contact 28, which, in turn, makes possible a contact between the electrically conductive bottom shaft 24 and thus also to the bottom main electrode 22.

The power circuit breaker 10 further comprises five secondary electrodes 30*a*, . . . , 30*e*, each of which is designed nearly disc-shaped and each of which is retained by the respective retainer 31*a*, . . . , 31*e*. The retainers 31 are preferably formed as metal plates, which are fastened to the insulator 12 or to one of the end plates 14, 16 (see also FIG. 2) and thus retain the secondary electrodes in a stable position. Alternatively, it is also possible for the retainers 31 to be designed as crosspieces or the like.

The secondary electrodes 30 each have an opening 32*a*, . . . 32*e* in the center portion, said openings being designed and arranged in such a way that the movable bottom main electrode 22 can be moved through it there. Preferably, the openings 32 are symmetrical to the positions of the bottom main electrode 22 along the perpendicular switching path thereof. When these positions are in the center of the openings 32, there is a minimum distance d between the exterior of the main electrode 22 and the interior of such an opening 32, as shown in FIG. 1. This distance d between the switching path sr and the secondary electrode 30 is less than 10 mm, with values of between 0.5 and 1 mm having especially proven useful. It is also possible that the topmost secondary electrode 30*a* is arranged in such a way that the top main electrode 18 is situated in the region of the opening 32*a*. Such designs are illustrated in FIGS. 3*a*-3*h* and 4, for example.

Figure 2:
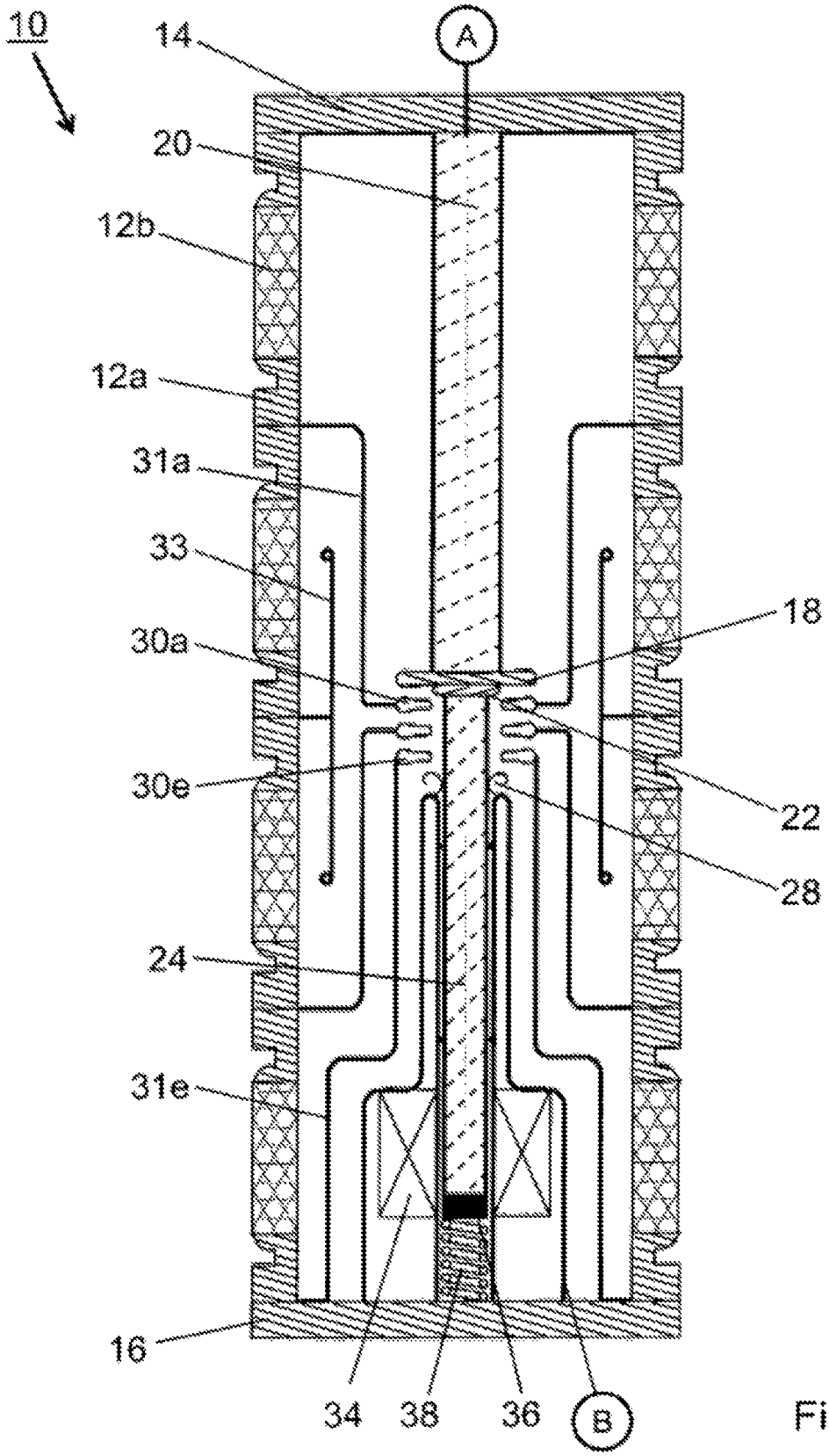
FIG. 2 a cross-sectional illustration of the power circuit breaker

FIG. 2 shows a cross-sectional illustration of the preferred power circuit breaker 10, which—as already mentioned above—is designed in an essentially circularly symmetrical or cylindrically symmetrical shape. For reasons of clarity, only three of the secondary electrodes 30*a*, . . . , 30*e* were illustrated. FIG. 2 shows, in addition, further possible modifications. Thus, in this case, the insulator 12 has first sections 12*a*, which are electrically conductive, as well as second sections 12*b*, which are electrically insulating. The first sections 12*a* are preferably made of metal. The second sections 12*b* are made of conventional material, such as ceramic or the like. Moreover, the top main electrode 18 is designed to be quite large in FIG. 2, so that the lateral dimension thereof is greater than that of the bottom main electrode 22.

Furthermore, the power circuit breaker 10 has a shielding metal plate 33 in this case. Together with the retainers 31*a* and 31*e*, which are preferably designed likewise as metal plates and thus also function as shielding metal plates, the dielectric face of the insulators 12 is thus shielded against flows of metal particles that ensue during creation and presence of an arc.

Illustrated in FIG. 2 are also an electromagnet 34, a permanent magnet 36, and a spring 38, which, when there is appropriate switching and actuation by suitable means (not shown here), make possible a vertical actuation of the bottom shaft 24—and thus also of the bottom main electrode 22—and hence are able to bring about a desired switching process by interconnecting or separating the two main electrodes 18, 22.

The arrangement of the magnets 34, 36 as well as the springs 38 shown in FIG. 2 is merely symbolic and indicates a power circuit breaker 10, which is realized as a gas-filled circuit breaker. For a vacuum circuit breaker, by contrast, the electromagnet 34 and the spring 38 are preferably mounted below the bottom end plate 16 and outside of the vacuum chamber.

What is unique in the present invention are the secondary electrodes 30 shown in the exemplary embodiments. These enable the arcs that usually form during the switching process to be extinguished in a simple way. This will be explained in detail by means of the following FIGS. 3*a*-3*h*.

FIGS. 3*a* to 3*h* schematically represent a sequence in the switching process regarding the main electrodes 18, 22 and the secondary electrodes 30*a* . . . 30*e*. During a switching process, in which the two main electrodes 18, 22 are separated from each other, various respective positions of the bottom main electrode 22 are shown in FIGS. 3*a* to 3*h*, one after the other. In addition, the secondary electrodes 30*a*, . . . , 30*e* are depicted as well as various arcs that can form during such a switching process. In the illustrated exemplary embodiment, the topmost secondary electrode 30*a* is situated essentially at the same height as the first main electrode 18, which is nearly fixed in position. It is assumed (not depicted here) that the bottom main electrode 22 was initially actuated in such a way that the two main electrodes 18, 22 came into contact and thereby a direct voltage of approximately 50 kV or more was switched. When the two main electrodes 18, 22 are separated, various arcs arise, which will be addressed in detail below. They are formed inside of a vacuum power circuit breaker in that metal particles are released from the material of the electrodes. Such arcs are unstable, however, and the occurrence or extinguishing thereof obeys statistical laws.

Figures 3A, 3B, 3C, 3D, 3E, 3F, 3G, 3H:
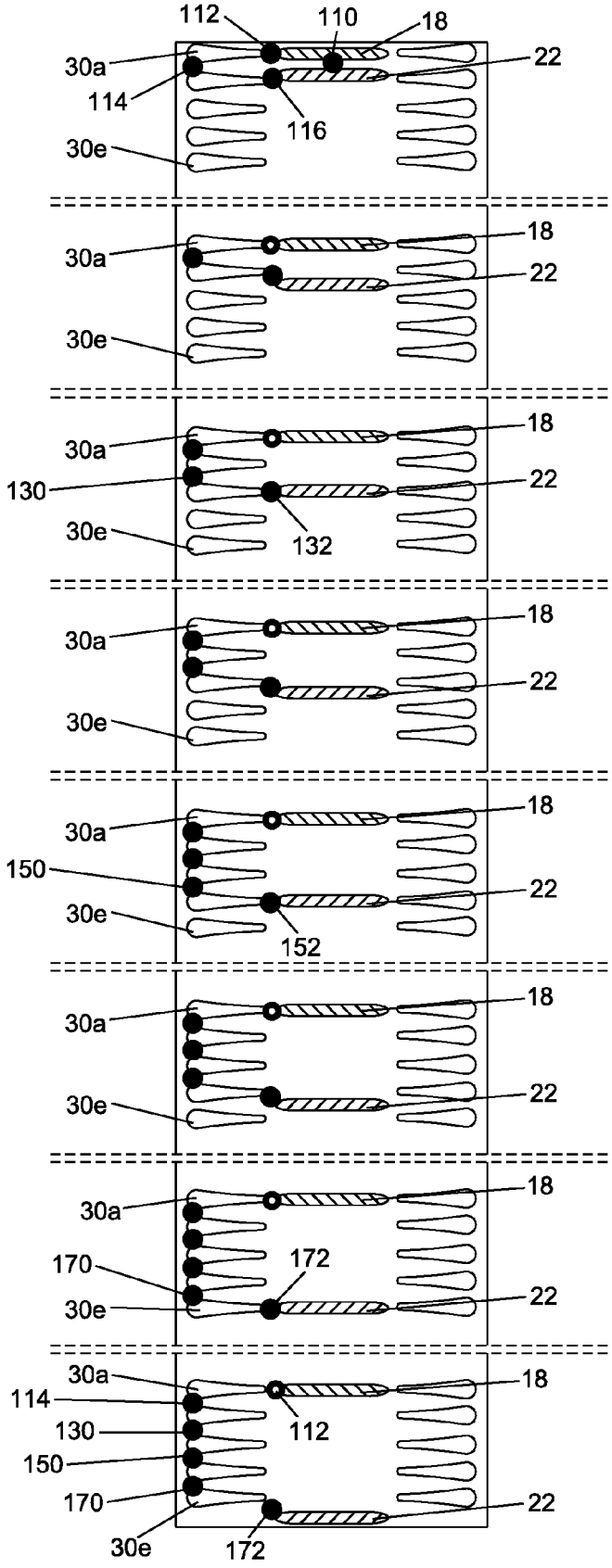
FIG. 3*a* schematically illustrates a first position of the main electrodes and the secondary electrodes FIG. 3*b* schematically illustrates a second position of the main electrodes and the secondary electrodes FIG. 3*c* schematically illustrates a third position of the main electrodes and the secondary electrodes FIG. 3*d* schematically illustrates a fourth position of the main electrodes and the secondary electrodes FIG. 3*e* schematically illustrates a fifth position of the main electrodes and the secondary electrodes FIG. 3*f* schematically illustrates a sixth position of the main electrodes and the secondary electrodes FIG. 3*g* schematically illustrates a seventh position of the main electrodes and the secondary electrodes FIG. 3*h* schematically illustrates an eighth position of the main electrodes and the secondary electrodes FIG. 4 an enlarged illustration of the secondary electrode 30*a* from FIG. 2

FIG. 3*a* shows the two main electrodes 18, 22 shortly after the separation thereof; here, the bottom main electrode 22 has assumed a position in which it is situated at about the same height as the secondary electrode 30*b*. Initially, in the separation process, an arc 110 is formed between the two main electrodes 18, 22. An arc 112 (between the top main electrode 18 and the secondary electrode 30*a*), an arc 114 (between the secondary electrodes 30*a*, 30*b*), and an arc 116 (between the secondary electrode 30*b* and the bottom secondary electrode 22) also arise nearly simultaneously.

FIG. 3*b* shows a situation in which the bottom main electrode 22 has moved further downward during the switching process. As a result, the distance between the main electrodes 18, 22 has become larger and the arc 110 that was originally present is extinguished. By contrast, the arcs 112, 114, and 116 are still present. For reasons of clarity, arcs that have already been described once are not provided separately with reference numbers again in the subsequent figures, as in the case here for the arcs 112, 114, and 116. Only in FIG. 3*h* are all arcs present there provided once again with reference numbers for completeness.

In FIG. 3*c*, the arc 116 is extinguished. Instead of it, an arc 130 (between the secondary electrodes 30*b*, 30*c*) and an arc 132 (between the secondary electrode 30*c* and the bottom electrode 22) have newly arisen. In FIG. 3*d*, the bottom main electrode 22 is situated below the secondary electrode 30*c*. However, the same arcs are present as in FIG. 3*c*.

In FIGS. 3*e* and 3*f*, the bottom main electrode 22 is situated at the same height as the secondary electrode 30*d* or just below it. As a result, the arc 132 is extinguished. However, an arc 150 (between the secondary electrodes 30*c* and 30*d*) and an arc 152 (between the secondary electrode 30*d* and the bottom main electrode 22) are formed.

In FIGS. 3*g* and 3*h*, the bottom main electrode 22 is situated at the height of the secondary electrode 30*e* or just below it. As a result, the arc 152 is extinguished. However, an arc 170 (between the secondary electrodes 30*d* and 30*e*) and an arc 172 (between the secondary electrode 30*e* and the bottom main electrode 22) are formed.

The arcs 112, 114, 130, 150, 170, and 172 that are present during the switching process as well as in the position according to FIG. 3*h*, in particular, have formed owing to the special design and positioning of the secondary electrodes 30 with respect to one another as well as with respect to the position of the top main electrode 18 and the switching path of the bottom main electrode 22. These arcs are connected virtually in series. This means that, when one of these arcs is extinguished owing to statistical laws, the entire spark gap is interrupted. As a result, arcs in the high-voltage power circuit breaker according to the invention are extinguished substantially earlier than in hitherto known power circuit breakers.

Figure 4:
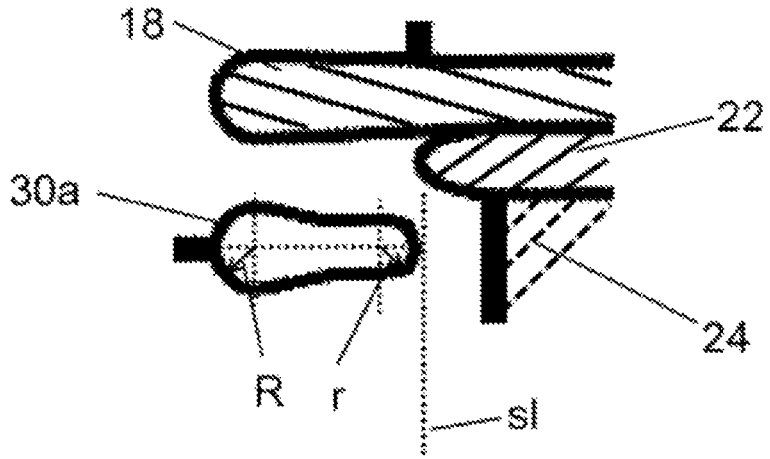

FIG. 4 is a cutout of FIG. 2 and shows, in enlargement, particularly the first secondary electrode 30*a*. It is clearly shown here that this secondary electrode 30*a* has a contour for which, toward the switching path—indicated here by its left boundary sl—a smaller radius r is realized than on the opposite-lying side, where a larger radius R exists. This means, therefore, that it has proven useful in the preferred embodiments for at least individual secondary electrodes 30 to be designed to be thinner or more pointed in the direction of the switching path sl, sr than on the other side. In this way, on the one hand, the secondary electrodes 30 have a quite small distance of a few millimeters in the outer region, that is, on the side facing away from the switching path sl, sr, as a result of which the arcs 114, 130, 150, and 170 (see FIGS. 3*a*-3*h*) can form; on the other hand, the secondary electrodes 30 have a markedly greater distance from one another in the region of the switching path sl, sr than toward the switching path sl, sr itself, as a result of which the arcs 112, 116, 132, 152, and 172 (see FIGS. 3*a*-3*h*) can form.

Figure 5:
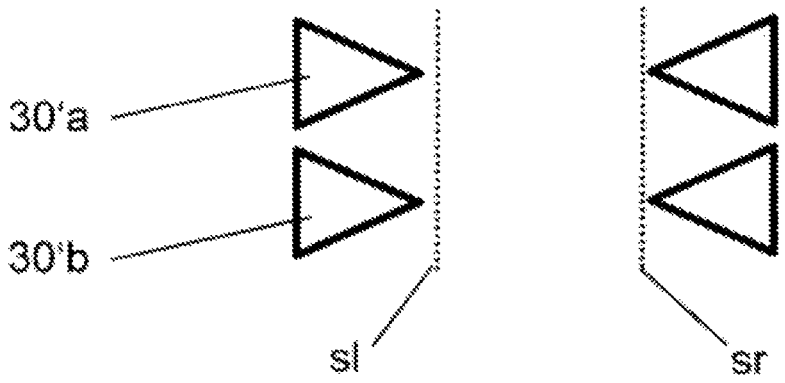
FIG. 5 secondary electrodes having a triangular contour

FIG. 5 shows two secondary electrodes 30'*a* and 30'*b* with an alternative contour, which—in perspective view—runs in each case from the switching path sl, sr outward in a triangular shape. In this way, it is possible for the distance between the secondary electrodes 30' to be greater in the region of the switching path sl or sr than on the outer side of the secondary electrode 30'.

Figure 6:
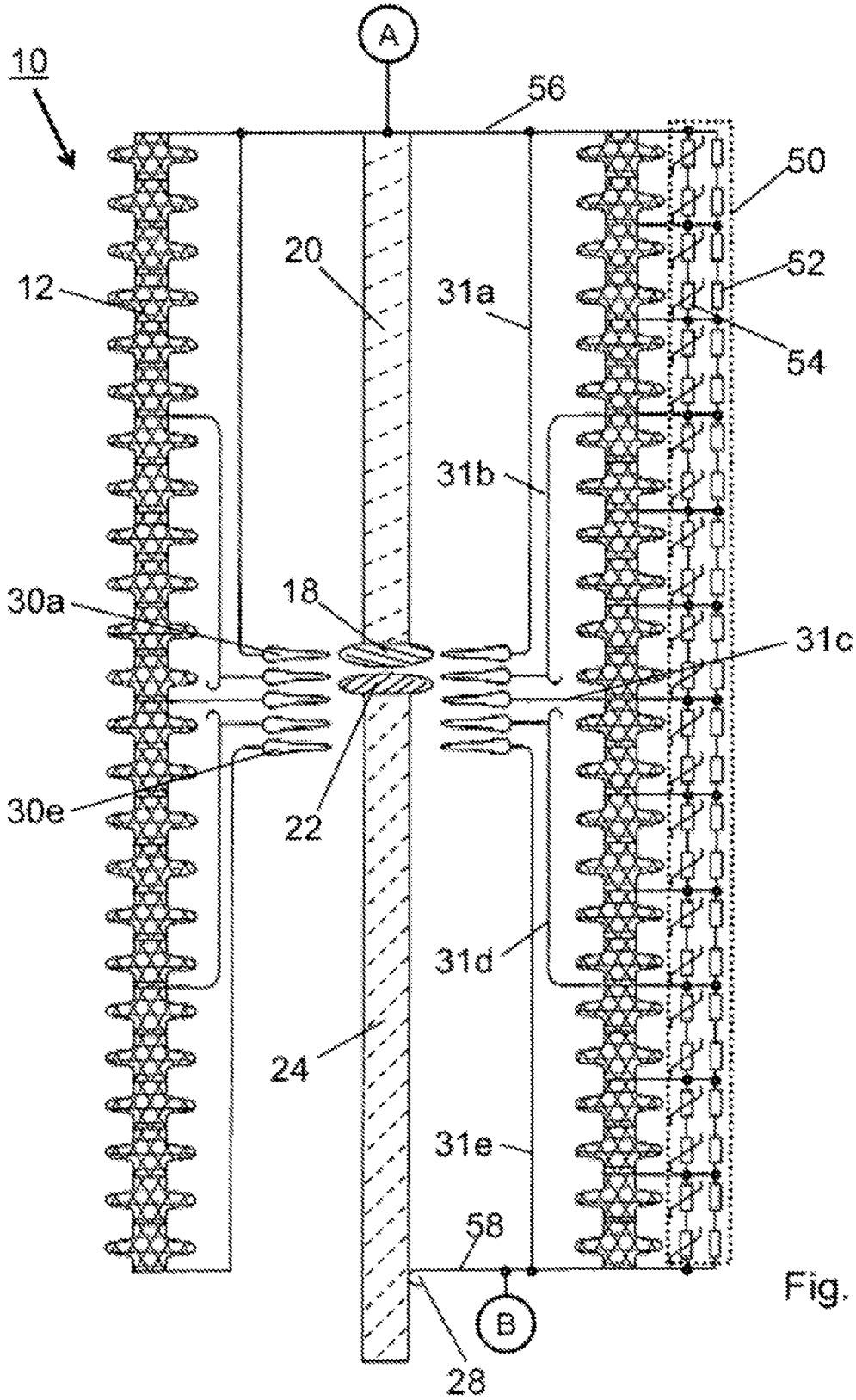
FIG. 6 another embodiment of the power circuit breaker with circuitry.

FIG. 6 shows, in a symbolic manner, another exemplary embodiment of the power circuit breaker 10 according to the invention. What is unique in it is the electronic circuit 50, which is composed of a plurality of ohmic resistors 52 as well as a plurality of voltage-dependent resistors 54, which will be referred to as varistors below. The resistors 52 and the varistors 54 are each connected in series. It has proven useful for a high-voltage power circuit breaker for each of the resistors 52 to have a value greater than 100 kΩ, with a range between 100 kΩ and 1 MΩ being especially advantageous. In the preferred exemplary embodiment, the varistors are designed in such a way that they have a limit voltage (threshold voltage) of approximately 1 kV.

The preferred embodiment of the power circuit breaker 10 is designed in such a way that voltages in the range of approximately 200 kV can be switched. When five secondary electrodes 30*a*, . . . , 30*e* are present in this case (as also depicted), four gaps result between these secondary electrodes 30*a*, . . . , 30*e*. In order to make possible an optimal spark gap with the sparks 114, 130, 150, 170 (see FIGS. 3*a*-3*h*), a sufficient number of the resistors 54 are arranged between each of the two secondary electrodes (30*a*-30*b*, 30*b*-30*c*, 30*c*-30*d*, 30*d*-30*e*) such that, in each case, a limit voltage of 50 kV results. If, then, as assumed above, each of the varistors 54 has a limit voltage of 1 kV, then 50 varistors 54 are arranged between each of the secondary electrode pairs 30*a*-30*b*, 30*b*-30*c*, 30*c*-30*d*, 30*d*-30*e*, so as to make possible the desired limit voltages. A good voltage distribution between the secondary electrodes 30 is ensured by the resistors 52.

In this embodiment, the electronic circuit 50 is connected as follows. The retainers 31 are each made of plate metal in this case, so that each of these retainer metal plates also functions as a shielding metal plate. The first metal retaining plate 31*a* is connected via a first electrical conductor 56 to the top main electrode 18 via the top shaft 20. Connected between the first metal retaining plate 31*a* and the second metal retaining plate 31*b* are a series of varistors 54, to which a series of resistors 52 are connected in parallel. In FIG. 6, six resistors 52 as well as six varistors 54 are shown between the first metal retaining plate 31*a* and the second metal retaining plate 31*b*. Six resistors 52 and six varistors 54 are also shown between each of the other adjacent metal retaining plates 31*b*-31*c*, 31*c*-31*d*, and 31*d*-31*e*. It is noted that this number is given only by way of example and can differ between adjacent metal retaining plates 31. This also means, furthermore, that the number of resistors 52 can be different from the number of varistors 54. Moreover, the last metal retaining plate 31*e* is electrically connected via a second electrical conductor 58 to the bottom main electrode 22 via the bottom shaft 24.

The exemplary embodiments presented in the figures and hitherto described are preferred embodiments of the present invention, for which various further developments and modifications are possible.

LIST OF REFERENCE NUMBERS

10 power circuit breaker
12 insulator
12*a* first section of 12 (electrically conductive)
12*b* second section of 12 (electrically insulating)
14 top end plate
16 bottom end plate
18 top main electrode
20 top shaft
22 bottom main electrode
24 bottom shaft
26 arrow
28 sliding contact
30*a*, . . . , 30*e* secondary electrodes
31*a*, . . . , 31*e* retainers of secondary electrodes
32*a*, . . . , 32*e* openings in the secondary electrodes
33 shielding metal plate
34 electromagnet
36 permanent magnet
38 spring
50 electronic circuit
52 resistors
54 varistors
56 first electrical conductor
58 second electrical conductor
110, 112, 114, 116 arc in FIG. 3*a*, 3*b* (first time)
130, 132 arc in FIG. 3*c*, 3*d* (first time)
150, 152 arc in FIG. 3*e*, 3*f* (first time)
170, 172 arc in FIG. 3*g*, 3*h* (first time)
A, B junction ports for high voltage
d distance between boundary of the switching path and edge of 32
r radius of the secondary electrode in the region of the switching path
R radius of the secondary electrode opposite the switching path
sl, sr left and right boundary, respectively, of the switching path

What is claimed is:

1. A power circuit breaker for switching electrical voltages, having a first electrode, which can be connected to a first pole (A) of the high voltage to be switched, and a second electrode, which can be connected to a second pole (B) of the voltage to be switched, with switching means being provided, which are suitable to move at least one of the electrodes along a switching path depending on a switching state and thereby to move the electrodes toward each other or away from each other, wherein at least one secondary electrode is present, which is situated in a vicinity of the switching path, and wherein more than one of the secondary electrodes is present and these secondary electrodes have a greater distance from one another in a region of the switching path than on a side facing away from the switching path.

2. The power circuit breaker according to claim 1, further characterized in that a distance between the switching path and the secondary electrode is one of less than 10 mm, and between 0.5 and 1 mm.

3. The power circuit breaker according to claim 1, further characterized in that it is designed as a vacuum power circuit breaker.

4. The power circuit breaker according to claim 1, further characterized in that the at least one secondary electrodes is designed in a shape of a ring or flat area and has an opening through which the switching path passes.

5. The power circuit breaker according to claim 1, further characterized in that one of the electrodes is arranged inside the power circuit breaker in nearly fixed position and the other one of the electrodes can be moved along the switching path.

6. The power circuit breaker according to claim 1, further characterized in that at least individual ones of the secondary electrodes are connected electrically to one another by means of a grid that contains at least one varistor and/or at least one resistor.

7. A power circuit breaker for switching electrical voltages having a first electrode which can be connected to a first pole (A) of the high voltage to be switched, and a second electrode, which can be connected to a second pole (B) of the voltage to be switched, with switching means being provided, which are suitable to move at least one of the electrodes along a switching path depending on a switching state and thereby to move the electrodes toward each other or away from each other, wherein at least one secondary electrode is present, which is situated in a vicinity of the switching path, and wherein the at least one secondary electrode has a contour such that it is thinner in a region of the switching path than on a side facing away from the switching path.

8. A power circuit breaker for switching electrical voltages, having a first electrode, which can be connected to a first pole (A) of the high voltage to be switched, and a second electrode, which can be connected to a second pole (B) of the voltage to be switched, with switching means being provided, which are suitable to move at least one of the electrodes along a switching path depending on a switching state and thereby to move the electrodes toward each other or away from each other, wherein at least one secondary electrode is present, which is situated in a vicinity of the switching path, and wherein more than one of the secondary electrodes is present and these secondary electrodes have a greater distance from one another in a region of the switching path than their minimum distance from the switching path.

9. A power circuit breaker for switching electrical voltages, having a first electrode, which can be connected to a first pole (A) of the high voltage to be switched, and a second electrode, which can be connected to a second pole (B) of the voltage to be switched, with switching means being provided, which are suitable to move at least one of the electrodes along a switching path depending on a switching state and thereby to move the electrodes toward each other or away from each other, wherein at least one secondary electrode is present, which is situated in a vicinity of the switching path, and wherein the at least one secondary electrode is designed in a shape of a ring or flat area and has an opening through which the switching path passes, and has a contour such that it is thinner in a region of the switching path than on a side facing away from the switching path.

10. A power circuit breaker for switching electrical voltages, having a first electrode, which can be connected to a first pole (A) of the high voltage to be switched, and a second electrode, which can be connected to a second pole (B) of the voltage to be switched, with switching means being provided, which are suitable to move at least one of the electrodes along a switching path depending on a switching state and thereby to move the electrodes toward each other or away from each other, wherein at least one secondary electrode is present, which is situated in a vicinity of the switching path, and wherein more than one of the secondary electrodes is present and these secondary electrodes have a greater distance from one another in a region of the switching path than on a side facing away from the switching path, and have a greater distance from one another in a region of the switching path than their minimum distance from the switching path.

11. The power circuit breaker according to claim 10, further characterized in that the at least one secondary electrode is designed in a shape of a ring or flat area and has an opening through which the switching path passes, and has a contour such that it is thinner in a region of the switching path than on a side facing away from the switching path.

12. A power circuit breaker for switching electrical voltages, said power circuit breaker comprising a first electrode which is connected to a first pole of a high voltage that is to be switched, a second electrode which is connected to a second pole of a voltage to be switched, a switching device for moving at least one of the electrodes along a switching path that extends between the electrodes and depending on a switching state, said switching device for moving the electrodes toward each other or away from each other, and at least one secondary electrode which is situated in the vicinity of the switching path, and wherein more than one of the secondary electrodes is present and these secondary electrodes have a greater distance from one another in a region of the switching path than on a side facing away from the switching path.

13. The power circuit breaker according to claim 12, further characterized in that a distance between the switching path and the secondary electrode is one of less than 10 mm, and between 0.5 and 1 mm.

14. The power circuit breaker according to claim 12, further characterized in that it is designed as a vacuum power circuit breaker.

15. The power circuit breaker according to claim 12, further characterized in that the at least one secondary electrodes has a contour such that it is thinner in a region of the switching path than on a side facing away from the switching path.

16. The power circuit breaker according to claim 12, further characterized in that more than one of the secondary electrodes is present and these secondary electrode have a greater distance from one another in a region of the switching path than their minimum distance from the switching path.

17. The power circuit breaker according to claim 12, further characterized in that one of the electrodes is arranged inside the power circuit breaker in nearly fixed position and the other one of the electrodes is moveable along the switching path.

* * * * *